US006410438B1

(12) United States Patent
Ozaki

(10) Patent No.: US 6,410,438 B1
(45) Date of Patent: Jun. 25, 2002

(54) METHOD AND DEVICE FOR POLISHING WORK EDGE

(75) Inventor: Haruo Ozaki, Hachioji (JP)

(73) Assignee: Emutech Co., Ltd., Tokyo (JP)

( * ) Notice: Subject to any disclaimer, the term of this patent is extended or adjusted under 35 U.S.C. 154(b) by 0 days.

(21) Appl. No.: 09/691,946

(22) Filed: Oct. 20, 2000

Related U.S. Application Data

(62) Division of application No. 09/369,261, filed on Aug. 6, 1999, now Pat. No. 6,248,005.

(30) Foreign Application Priority Data

Aug. 9, 1998 (JP) ..... 10-237986

(51) Int. Cl.[7] ..... H01L 21/302
(52) U.S. Cl. ..... 438/690; 438/691; 451/254
(58) Field of Search ..... 451/44, 43, 254, 451/258, 388; 438/690, 691, 692

(56) References Cited

U.S. PATENT DOCUMENTS 3,982,359 A * 9/1976 Elbel et al. ..... 51/295
4,031,667 A * 6/1977 Sehestedt ..... 51/105
4,305,898 A * 12/1981 Obersby ..... 264/25
4,901,479 A * 2/1990 Helm ..... 51/170
5,097,630 A * 3/1992 Maeda et al. ..... 51/50 R
5,317,836 A 6/1994 Hasegawa et al. ..... 451/44
5,658,189 A * 8/1997 Kagamida ..... 451/66
6,066,031 A 5/2000 Noguchi et al. ..... 451/44

FOREIGN PATENT DOCUMENTS

EP 0308134 3/1989 ..... 451/44
JP 403196954 8/1991 ..... 451/388

* cited by examiner

*Primary Examiner*—Benjamin L. Utech
*Assistant Examiner*—Kin-Chan Chen
(74) *Attorney, Agent, or Firm*—Finnegan, Henderson, Farabow, Garrett, & Dunner, L.L.P.

(57) ABSTRACT

Method and device for polishing an edge of a work is disclosed, wherein a rubber wheel 6 containing abrasives is rotated in a plane normal to a surface of a work 5 in a form of a thin plate having an edge 5*a* to be polished. A spindle portion 8 holding the rubber wheel such that the rubber wheel is driven to rotate in a plane normal to the surface of the work. A mount portion 4 for mounting the work 5 thereon such that the work 5 is movable straight with respect to the rubber wheel 6 in a plane normal to the plane in which the rubber wheel 6 is rotated. Elastic means 9 is provided to urge the spindle portion 8 and the work mounting portion 4 in a direction so as to bring the rubber wheel 6 and the edge 5*a* of the work 5 in contact with each other, wherein one of the spindle portion 8 and the mount portion 4 is movable toward and away from the other during polishing operation.

7 Claims, 5 Drawing Sheets

METHOD AND DEVICE FOR POLISHING WORK EDGE

This is a divisional of application Ser. No. 09/369,261, filed Aug. 6, 1999, now U.S. Pat. No. 6,248,005 B1 which is incorporated herein by reference.

BACKGROUND OF THE INVENTION

1. Field of the Art

The invention relates to method and device for polishing the edge of a work, and more particularly relates to polishing the edge of a work by use of a rubber wheel (RBW= RUBBER BONDED WHEEL) containing abrasives, instead of using the slurry containing diamond particles for abrasives which may obstruct the tubes of the device and adversely affect the electromagnetic valves and further may be easily congealed at various places, wherein the heat produced by polishing operation is cooled down by air or water, thereby to maintain the quality of the polished work and further to significantly reduce the production cost as well as the running cost of the device.

2. Prior Art

The wafers such as silicon wafers are generally referred to the thin disk-shaped semiconductor elements, and are normally cut out from a refined cylindrical single crystal mother material. The wafer is polished on one side thereof just like a mirror surface and then the surface is provided with various semiconductor elements by way of etching. Further the wafer is required to have the peripheral edge thereof trimmed by way of the emery wheel of diamond and is then polished just like a mirror surface by way of the buff polishing wheel using the slurry, thereby to prevent the dusts from sticking to the surface of the peripheral edge.

Since the conventional polishing wheel is poor in the polishing ability by itself, the slurry containing diamond particles is used to polish the wafer utilizing the chemical etching effect of the slurry which is alkaline. The slurry is a gel which is a mixture of fine abrasive particles of diamond and an alkaline solution (about pH 11).

In case the slurry is used to polish a work, it is necessarily required to provide a solution having the silicon abrasive particles mixed into the slurry. The conventional polishing machine is provided with a separator which is used to separate the abrasive particles from the used slurry after this is recovered, so as to repeatedly use the slurry. The used slurry is, therefore, sent to the tank of the separator through the tubes and the electromagnetic valves. Such a slurry has a nature of hardening and sticking to the objects when it is retained in the tubes and the tank for a long period of time. This will obstruct the tubes and adversely affect the electromagnetic valves.

This is the reason that the slurry is often called as "a devil water". In order to avoid the obstruction of the tubes, it is required to design the series of tubes to have a flushing structure so as to enable the series of tubes to be washed away of the slurry immediately after the slurry has passed the tubes. Further the metal portions of the device including iron which contact the slurry is required to be the expensive stainless steel coated with Teflon having a thickness of about 0.1 mm so as to avoid the corrosion due to the slurry and also to prevent the slurry from sticking to the portions. Further the tubes must be the Teflon tubes which may be expensive 7 to 10 times as much as the ordinary vinyl tubes. Thus the conventional polishing machine is considerably expensive in the production cost as well as in the running cost.

Further, in case of polishing by use of the slurry, it is required to settle the slurry in the tank bath after the polishing operation to remove the slurry from the solution by washing by way of supersonic waves and then to proceed to the subsequent process. This will considerably reduce the operation efficiency in addition to the probability of adverse influence of the slurry etching upon the wafer. Therefore, it has long been desired to realize the method for polishing the work without using the slurry.

On the other hand, if a rubber wheel containing abrasives is employed instead of the buff wheel, the rubber wheel will be rapidly abraded because the rubber wheel can not yieldingly traverse with respect to the work. Further the rubber wheel will damage the work such as the wafer because the rubber wheel is not so soft as the buff wheel. It is, therefore, required to provide some compensation for the hard rubber wheel to suitably polish the work such as the wafer.

OBJECTS OF THE INVENTION

The invention has been provided to eliminate the defects and disadvantages of the prior art. It is, therefore, a principal object of the invention to rotate a rubber wheel containing abrasives in a plane normal to the surface of a thin disk-shaped work and to press the rubber wheel against the peripheral edge of the work without using slurry while using air or water to cool down the heat which is produced during polishing operation.

It is another object of the invention to provide a work edge polishing device significantly inexpensive in the production cost as well as in the running cost, for example, ½ to 1/10 compared with the conventional device.

It is another object of the invention to provide a plurality of rubber wheels of different polishing abilities which may be occasionally interchanged to polish a specifically hard work in step by step.

It is another object of the invention to provide a rubber wheel having an outer periphery adapted to elastically engage the peripheral edge of the semiconductor wafer so as to polish the edge in a shape of arc.

It is another object of the invention to yielingly move one of the rubber wheel and the work to and from the other during polishing operation so as to moderate the polishing force eliminating the risk of strain or crack which may otherwise be caused in the work.

It is still another object of the invention to provide an adjusting means for adjusting the yielding amount of one of the rubber wheel and the work to and from the other during polishing operation in dependence upon the material of the work to be polished.

SUMMARY OF THE INVENTION

In short, the invention substantially comprises disclosed, a rubber wheel containing abrasives and being rotated in a plane normal to a surface of a disk shaped work having a peripheral edge to be polished, a spindle portion holding the rubber wheel such that the rubber wheel may be rotated in a plane normal to the surface of the work, a mount portion for mounting the work thereon such that the work may be movable straight with respect to the rubber wheel in a plane normal to the plane in which the rubber wheel is rotated, elastic means for urging at least one of the spindle portion and the work mounting portion in a direction wherein the rubber wheel and the edge of the work contact with each other, wherein one of the spindle portion and the mount portion is movable toward and away from the other during polishing operation.

DETAILED DESCRIPTION OF PREFERRED EMBODIMENT

Figure 1:
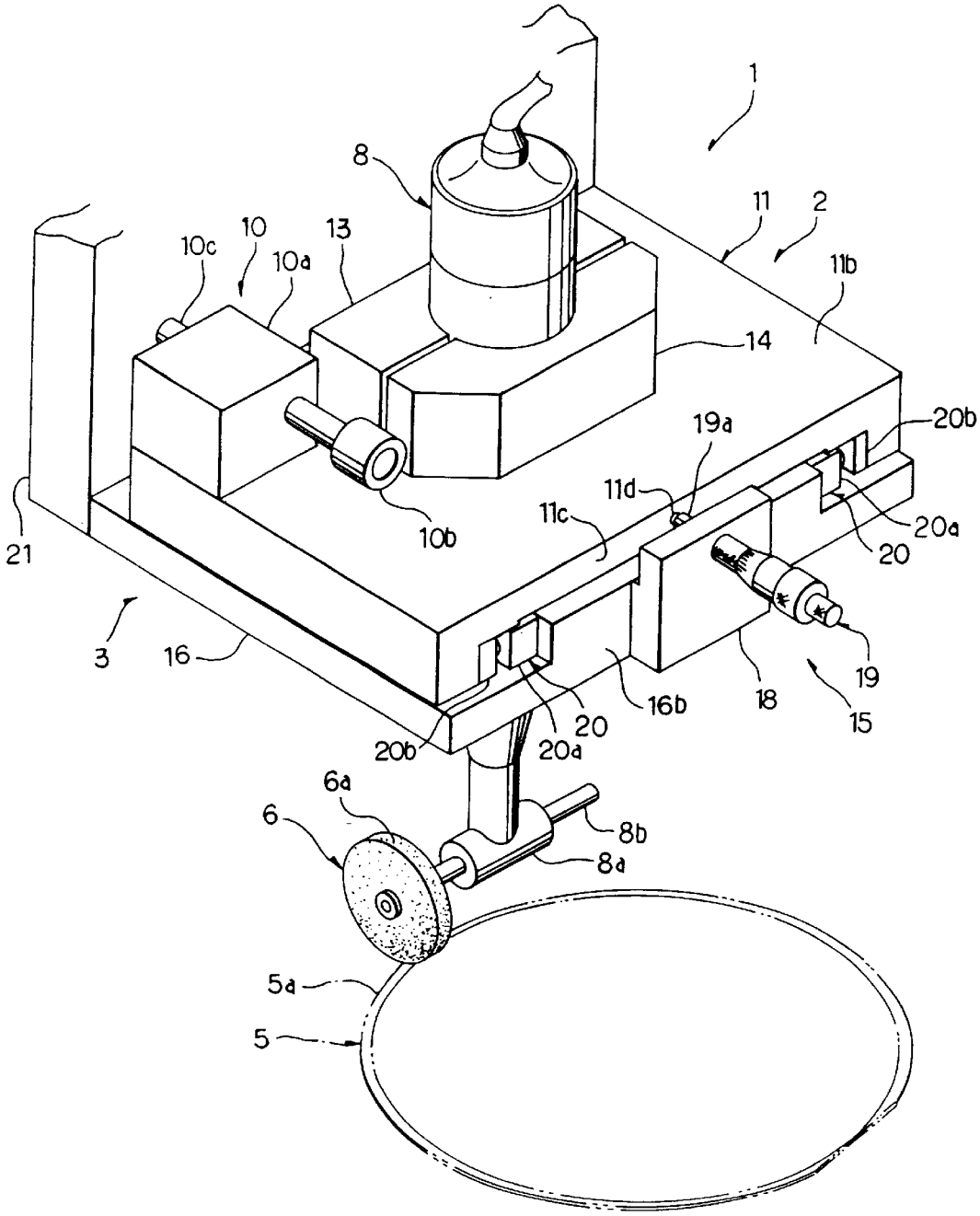
FIG. 1 is a perspective view of the work edge polishing device according to the invention.
Figure 4:
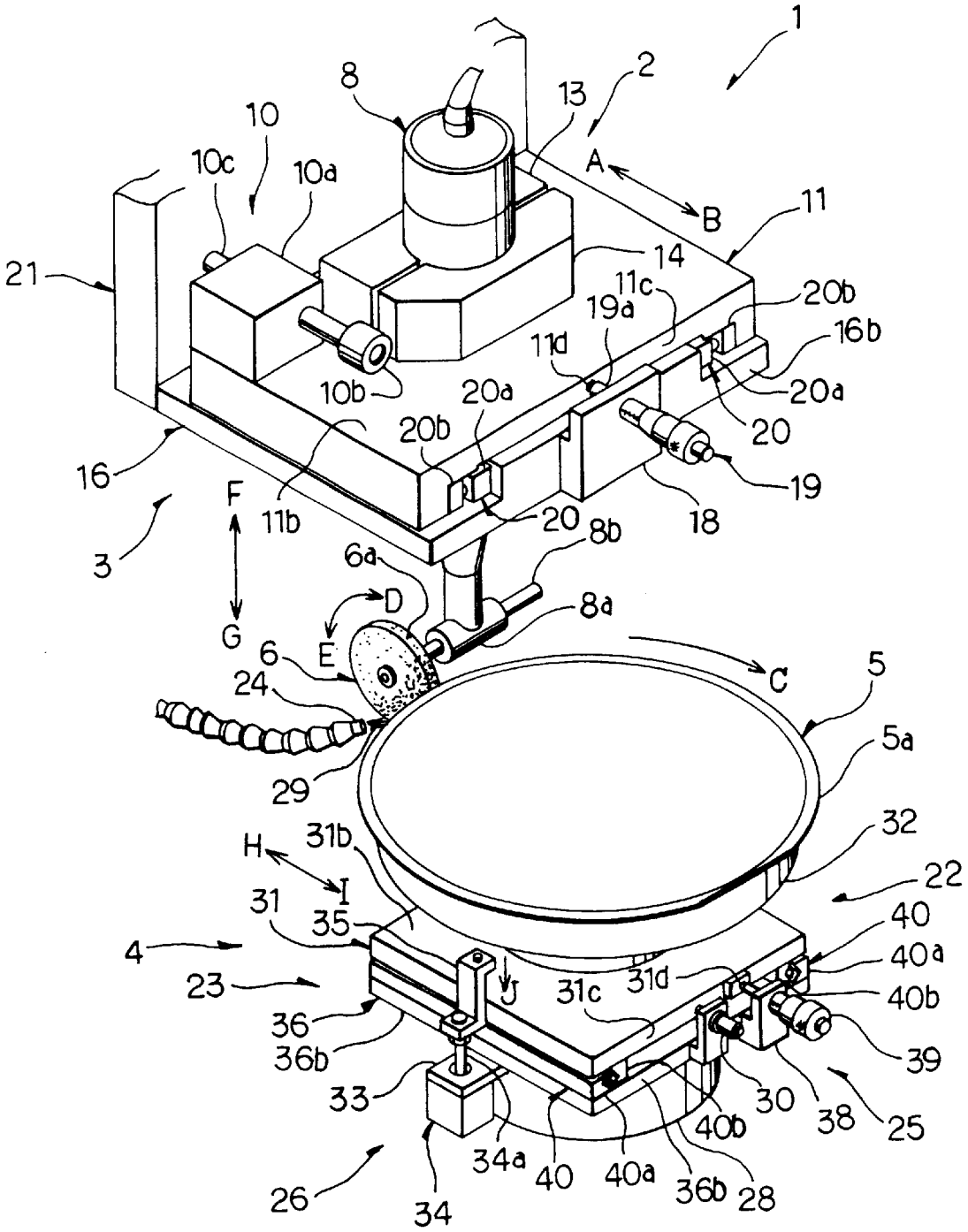
FIG. 4 is a perspective view of the work edge polishing device showing a condition for polishing the edge of a work by means of a rubber wheel.

The invention will now be described in reference to the attached drawings. In FIGS. 1 and 4, the work edge polishing device 1 of the invention is substantially composed of a floating portion 2, a fixed portion 3 and a work mounting portion 4.

The polishing device is designed to rotate a rubber wheel 6 containing abrasives such as diamond particles to polish the edge 5*a* of a thin plate-like work 5 by means of the outer periphery 6*a* of the rubber wheel 6.

The floating portion 2 is mounted on the fixed portion 3 with a linear guide 20 being interposed therebetween and is slightly slidingly movable with respect to the fixed portion 3 in the directions in which the rubber wheel 6 and the edge 5*a* of the work 5 are moved toward and away from each other.

Figure 2:
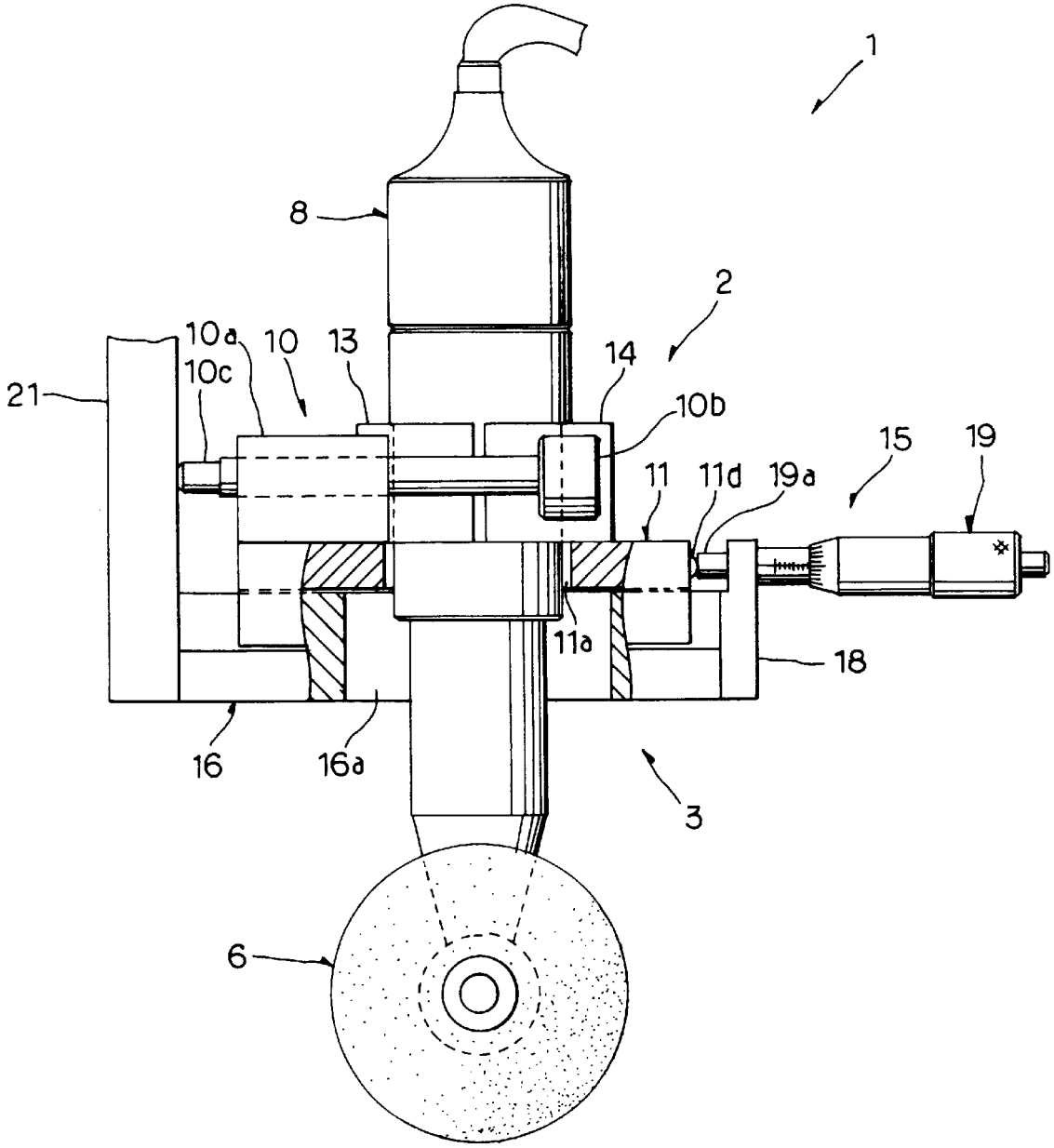
FIG. 2 is a side elevational view of the essential part of the work edge polishing device shown partly in vertical section.
Figure 3:
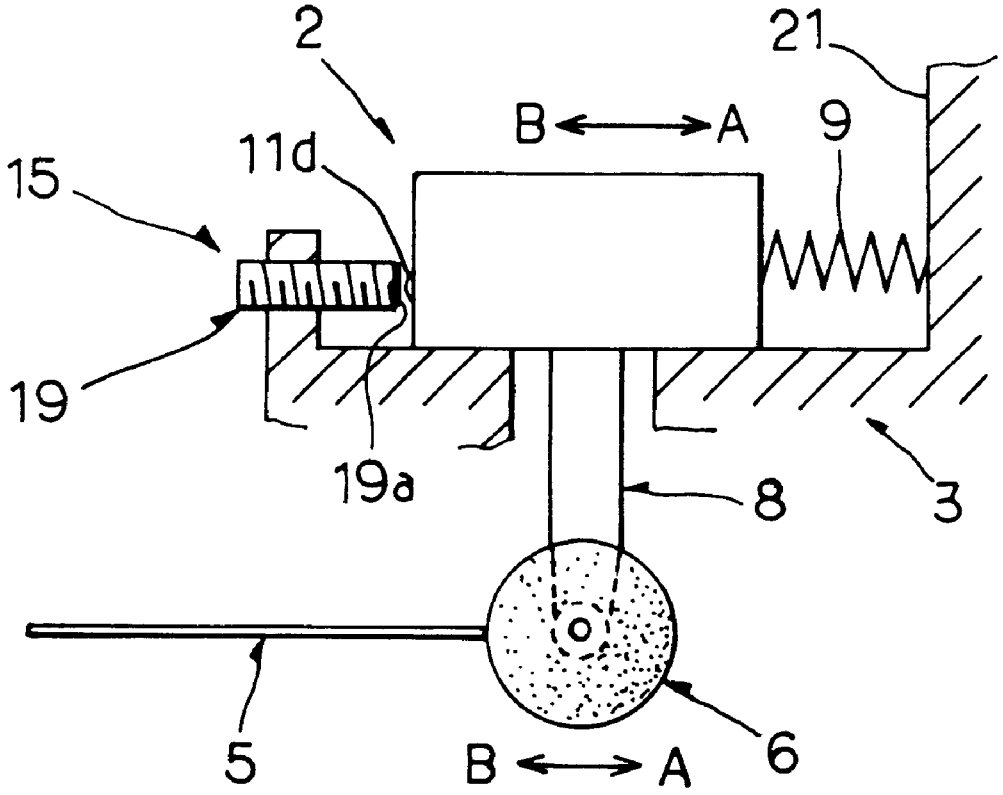
FIG. 3 is a side elevational view of an adjusting mechanism for movable portions of the invention shown partly in vertical section in connection with a rubber wheel and a work to be polished by the rubber wheel.

In FIGS. 1, 2 and 3, the floating portion 2 includes a floating plate 11 which is substantially of a U-shape and arranged in a horizontal plane. On the horizontal floating plate 11, there are mounted a spindle 8 for rotating the rubber wheel 6 in a plane normal to the surface of the work 5 which is a thin plate such as a semiconductor wafer, an elastic member 9 for pressing the rubber wheel 6 against the edge 5*a* of the work 5 and a polishing action adjusting mechanism 10 for adjusting the pressing action of the elastic member 9.

The spindle 8 is arranged vertically of the movable plate extending through a central hole 11*a* of the floating plate 11 and is clamped by blocks 13 and 14 which are fixed to the upper surface 11*b* of the floating plate 11 clamping. The spindle 8 is elongated and has a longitudinal rotation axis, the rotation of which is converted into the rotation of a lateral axis at one end thereof to rotate the rubber wheel 6 just like a dental treating instrument as generally known, so that the rubber wheel 6 may be rotated in a plane normal to the surface of the work 5.

The elastic member 9 is a gas spring or a compression spring provided in the polishing action adjusting mechanism 10 for pressing the spindle 8 such that the rubber wheel 6 may be normally urged toward the edge 5*a* of the work 5 positioned on the mount 4.

The polishing action adjusting mechanism 10 is operated to adjust the spring action of the elastic member 9 in dependence upon the type of material of the work 5, and has the elastic member 9 accommodated in a block 10*a* fixed to the upper surface 10*b* of the floating plate 11, and has an screw member 10*b* operated to adjust the spring action of the elastic member 9 and a pin 10*c* which is pressed against a column 21 of the fixed portion 3 as the floating portion 4 retreats and then pushed into the block 10*a* to compress the elastic member 9 thereby to produce the polishing action. The screw member 10*b* and the pin 10*c* are coaxially arranged. The screw member 10*b* may be previously operated to deform the elastic member 9 so as to adjust the polishing action.

The fixed portion 3 supporting the floating portion 2 is provided with a mechanism 15 for adjusting the floating amount of the floating portion 2. The fixed portion 3 includes a fixed plate 16 of sectionally ⊔-shape for supporting the floating portion 2 thereon while the floating portion 2 is fixedly connected to the column 21 arranged vertically of the fixed plate 16 and is movable in vertical direction. The fixed plate 16 has a diametrically elongated hole 16*a* through which the spindle 8 extends so that the spindle 8 may be free of contact with the fixed plate 16 when the floating portion 2 floats.

As shown in FIGS. 1 to 3, the floating amount adjusting mechanism 15 includes a micrometer head 19 having a forward end 19*a* and mounted on a bracket 18 fixed to the front side of the fixed plate 16. A ball 11*d* is mounted on the front side of the floating plate 11 and is kept in contact with the forward end 19*a* of the micrometer head 19.

The linear guide 20 includes fixed side rails 20*a* (one of which is illustrated) provided on the fixed plate 16 and movable side rails 20*b* provided on the floating plate 11. A nozzle 24 is directed to the peripheral edge 6*a* of the rubber wheel 6 as shown in FIG. 4 to provide a fluid 29 such as water or air for cooling down the heat which is produced at the polishing operation.

In FIG. 4, the work mounting portion 4 is designed to move straight while suckingly fixing the work 4 thereon and is composed of a spindle side portion 22, a drive side portion 23, a stopper mechanism 25, a pair of lock mechanisms 26 for locking the spindle side portion 22 and the drive side portion 23, and a polishing action adjusting mechanism 30. The spindle side portion 22 is mounted on the drive side portion 23 with a linear guide 40 interposed therebetween. Thus the spindle side portion 22 is designed slidingly movable with respect to the drive side portion 23 in the directions in which the rubber wheel 6 and the edge 5*a* of the work 5 are moved toward and away from each other when the lock mechanism 26 is unlocked.

The spindle side portion 22 a floating plate 31 arranged in a horizontal plane and having a hole (not shown) through which a spindle 28 is vertically extended while fixed thereto. A work mount 32 is provided on the top of the spindle 28. The upper side 31*b* of the floating plate 31 has hole (not shown) formed thereat for receiving a pin (not shown) which is driven when the lock mechanism 26 is operated to lock the spindle side portion 22 and the drive side portion 23. The front side 31*c* of the floating plate 31 has a ball 31 provided thereon to be kept in contact with the stopper mechanism 25. The work mount 32 is a circular member for fixing the work 5 thereto by sucking attraction and is rotatable together with the spindle 28.

The drive side portion 23 includes a horizontally arranged fixed plate 36 providing a base for the spindle 28 to be mounted thereon. The topper mechanism 25 and the polishing action adjusting mechanism 30 are provided on the front side 36*a* of the fixed plate 36 while the lock mechanisms 26 (one of which is illustrated) are provided on both lateral sides of the fixed plate 36 respectively.

The stopper mechanism 25 includes a micrometer head 39 mounted on a bracket 38 fixed to the front side 36*a* of the fixed plate 36 and being previously operated to set a maximum retreating amount of the spindle side portion 22 during polishing operation.

The polishing action adjusting mechanism 30 includes the elastic member 9 such as a gas spring or a compression spring just as the same in the case of the floating portion 2 for applying a reaction force to the spindle side portion 22 while it retreats during polishing operation, thereby to produce polishing force. The polishing action adjusting mechanism 30 may be previously operated to deform the elastic member 9 to adjust the polishing action in the same manner as the polishing action adjusting mechanism 10.

The lock mechanism 26 is operated to fixedly connect the spindle side portion 22 and the drive side portion 23 when the work 5 is polished without being floated, and includes an air cylinder 34 mounted on a bracket 33 fixed to the fixed plate 36. The air cylinder 34 has a piston rod 34*a* which is connected to a lock member 35 having a tapered pin (not shown) fixed thereto.

The linear guide 40 includes fixed side rails 40*a* (one of which is illustrated) provided on the fixed plate 36 while movable side rails 40*b* provided on the floating plate 31.

The method for polishing the work edge of the invention (claim 1) is to rotate the rubber wheel 6 containing abrasives in a plane normal to the surface of a thin plate-like work 5 and to press the rubber wheel 6 against the edge 5*a* of the work 5, thereby to polish the edge 5*a* without using slurry.

Further the method for polishing the work edge of the invention (claim 2) is to rotate the rubber wheel 6 containing abrasives in a plane normal to the surface of a thin plate-like work 5 to lightly press the rubber wheel 6 against the work edge 5*a* of the work 5 by means of the elastic member 9 so that the rubber wheel 6 may be occasionally yieldable to the edge 5*a* of the work 5, thereby to polish the work edge 5*a* without using slurry.

The invention is structured as mentioned above and the operations are as follows: In FIG. 4, the spindle 28 is rotated, thereby to rotate the work 5 suckingly attracted to the work mount 32 in the direction as shown by the arrow C. Then the spindle 28 is moved in the direction as shown by the arrow H, thereby to press against the edge 5*a* of the work 5 toward the outer periphery 6*a* of the rubber wheel 6 which is rotated by the spindle 8. Thus the work 5 is polished by the rubber wheel 6 containing abrasives. The heat produced due to the polishing operation is cooled down by the cooling fluid 29 jetted out of the nozzle 24.

The operations of the constituent elements of the device are as follows: In FIGS. s and 4, prior to the polishing operation, the spindle side portion 22 and the drive side portion 23 may be locked to each other by the lock mechanism 26 by operating the lock mechanism 26 so as to move the piston rod 34*a* of the air cylinder 34 in the direction as shown by the arrow J, thereby to insert the tapered pin (not shown), which is mounted to the lock member 35, into the hole (not shown) formed at the floating plate 31. In this case, the fixed portion 3 is movable only in the vertical directions as shown by the arrows F and G due to the contact between the edge 5*a* of the work 5 and the rubber wheel 6 while the floating portion 2, on which the spindle 8 is mounted, is floatingly yieldable as guided by the linear guide 20 in the direction as shown by the arrow A. Then the pin 10*c* of the polishing action adjusting mechanism 10 is pressed against the elastic member 9 to compress the same, thereby to produce the reaction force of the elastic member 9. The reaction force of the elastic member 9 results in production of the polishing force effecting only the polishing force proportional to the yielding amount of the floating portion 2 to be applied to the edge 5*a* of the work 5. It is, therefore, apparent that the edge 5*a* of the work 5 may be polished with a considerably weaker force compared with the direct polishing without employment of the elastic member 9. Thus it is possible to polish the edge 5*a* of the work 5 such as the very fragile silicon semiconductor wafer by means of the rubber wheel 6 without the risk of cracks and/or strains which may otherwise be caused on the work 5.

The initial polishing force at the instant time when the edge 5*a* of the work 5 contacts the rubber wheel 6 may be adjusted by operating the polishing action adjusting mechanism 10 to move the adjusting screw 10*b* with respect to the elastic member 9. If the adjusting screw 10*b* is advanced with respect to the elastic member 9, the adjusting screw 10*b* will compress the elastic member 9 to increase the initial polishing force. On the other hand, if the adjusting screw 10*b* is retreated with respect to the elastic member 9, the adjusting screw 10*b* will allow the elastic member 9 to expand to decrease the initial polishing force. Thus the polishing action adjusting mechanism 10 may be adjusted prior to the polishing operation in dependence upon the type of material of the work 5 to be polished.

When the polishing operation has been finished, the work mounting portion 4 is moved in the direction as shown by the arrow I, as shown in FIG. 4, to separate the edge 5*a* of the work 5 from the rubber wheel 6. The floating portion 2 is then returned in the direction as shown by the arrow B due to the reaction force of the elastic member 9 until the ball 11*d* of the floating plate 11 is pressed against the forward end 19*a* of micrometer head 19 of the floating amount adjusting mechanism 15 as will be understood in reference to FIGS. 3 and 4. If the floating amount adjusting mechanism 15 is operated to provide a large amount of floatation, the stroke of the elastic member 9 will be so long providing a wide range of polishing operations from a weakest polishing force to a strongest polishing force.

On the other hand, prior to the polishing operation, the spindle side portion 22 and the drive side portion 23 may be left unlocked from each other wherein a gap (not shown) is provided between the ball 31*d* of the floating plate 31 and the micrometer head 39 of the stopper mechanism 25. In this case, due to the contact of the edge 5*a* of the work 5 with the rubber wheel 6, the spindle side 22 of the work mounting portion 4 is yieldable in addition to the yielding movement of the floating plate 11 of the floating portion 20. In fact, as the drive side portion 23 is designed to move by numerical control, the drive side portion 23 will not be moved due to the contact of the edge 5*a* of the work 5 with the rubber wheel 6. The spindle side 22 of the work mounting portion 4 is, however, adapted to slightly yieldingly move in the direction by the arrow I as guided by the linear guide 40 until the ball 31*d* of the floating plate 31 comes to be pressed against the micrometer head 39. In this case, since the reaction force of the elastic member 9 determined by the polishing action adjusting mechanism 30 represents the polishing force, the polishing force proportional to the yielding amount I is applied to the edge 5*a* of the work 5.

The polishing action adjusting mechanism 30 may be previously operated to adjust the initial polishing force at the instant time when the edge 5*a* of the work 5 contacts the outer periphery 6*a* of the rubber wheel 6. On the other hand, the micrometer head 39 of the stopper mechanism 25 may be previously operated to determine a maximum amount of the floating movement, that is the yielding amount of the spindle side portion 22.

When the polishing operation has been finished, the work mounting portion 4 is moved in the direction as shown by the arrow I, as shown in FIG. 4, to separate the edge 5*a* of the work 5 from the rubber wheel 6. The floating portion 2 is then returned in the direction as shown by the arrow B due to the reaction force of the elastic member 9 until the ball 11*d* of the floating plate 11 is pressed against the forward end 19*a* of micrometer head 19 of the floating amount adjusting mechanism 15 while the spindle side portion 22 is returned in the direction as shown by the arrow H as will be understood in reference to FIGS. 3 and 4.

By the way, it is possible to do a similar polishing operation only with the floating portion provided on the work mounting portion 4 and not provided on the rubber wheel side portion 3. Further, the rubber wheel 6 may be occasionally replaced by the one containing the abrasive particles of different size to provide a different polishing ability. Thus the work 5 of may be polished with successive steps of different polishing forces. Any work 5 of a hard material such as an epitaxial wafer made of silicon dioxide may be easily polished by use of the rubber wheel 6 of the invention.

Figure 5A:
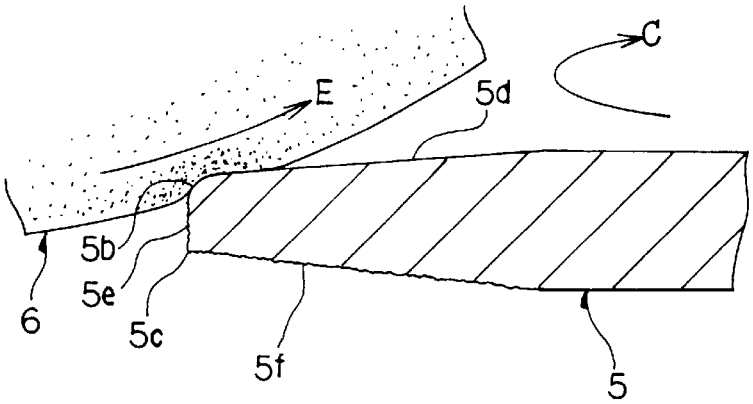
FIGS. 5A through 5C are side elevational views of the rubber wheel and the work showing the work polishing processes respectively.
Figure 5B:
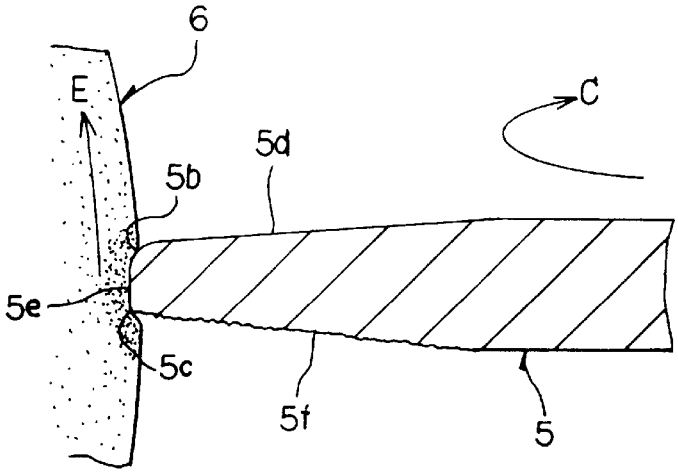
Figure 5C:
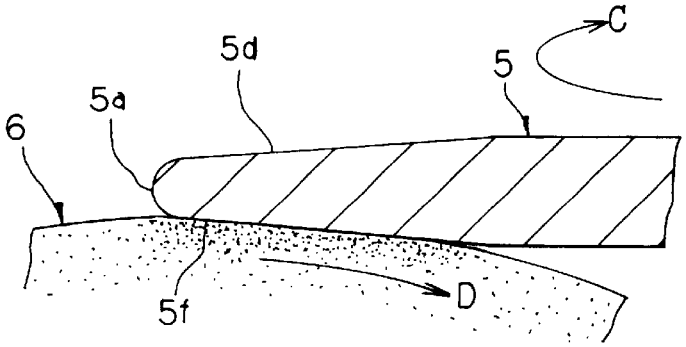

The polishing processes will now be described in reference to FIGS. 5A through 5C. Prior to the polishing process, the work 5 is subjected to a trimming process and a grinding process. After the work 5 has been ground, the work 5 has sharp upper and lower edges 5*b* and 5*c*. Firstly as shown in FIG. 5A, the rubber wheel 6 is rotated in the direction as shown by the arrow E while the work 5 is rotated in the direction as shown by the arrow C with the upper edge 5*b* of the work 5 being kept in contact with the outer periphery 6*a* of the rubber wheel 6. Thus the upper edge 5*b* and the edge face 5*d* of the work 5 are polished by way of upper cutting. Subsequently as shown in FIG. 5B, the rubber wheel 6 and the work 5 are traversed to each other so as to polish the outer periphery 5*e* of the work 5 by way of upper cutting. Finally as shown in FIG. 5C, the rubber wheel 6 is rotated in the direction as shown by the arrow D while the lower edge 5*c* and the lower side 5*f* of the work 5 are pressed against the outer periphery 6*a* of the rubber wheel 6. Thus the lower edge 5*c* and the lower side 5*f* of the work 5 are polished by way of upper cutting. Thus the polishing operation of the work 5 is finished.

Since the outer periphery 6*a* of the rubber wheel 6 is yieldingly deformed during the polishing operation when the outer periphery 6*a* of the rubber wheel 6 is kept in contact with the upper edge 5*b* and the lower edge 5*c*, the upper edge 5*b* and the lower edge 5*c* may be polished into a form sectionally of arc of circle. Further, since the polishing operation is performed while the rubber wheel 6 and the work 5 are traversed with each other, the rubber wheel 6 will not be suffered from partial abrasion and therefore will wear so long.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A method for polishing an edge of a thin plate having at least one surface with a rubber wheel containing abrasives and mounted to a spindle drivable to rotate said rubber wheel in a plane normal to the at least one surface of said thin plate while said thin plate is mounted to a mount portion movable linearly with respect to said rubber wheel, said spindle and said thin plate mounting portion being biased by elastic means in a direction to bring said rubber wheel and said edge of said thin plate in contact with each other, said method comprising the steps of:

(a) driving said spindle to rotate said rubber wheel in the plane normal to said at least one surface of said thin plate, (b) moving one of said spindle and said thin plate mounting portion toward and away from the other during a polishing operation, (c) floating said spindle on a first floating plate movable in a plane normal to the plane in which said rubber wheel is rotated, (d) floating said thin plate mounting portion on a second floating plate movable in a plane parallel with the plane in which said first plate is floated, and (e) bringing said rubber wheel and said edge of said thin plate into contact with each other under the bias of first and second compression springs of said elastic means acting respectively on said first and second floating plates.

2. The method of claim 1, including adjusting the spring force of said compression springs, and adjusting the floating movement amounts of said first and second floating plates.

3. The method of any one of claims 1 and 2, including guiding the movements of said first and second floating plates.

4. The method of any one of claims 1 and 2, wherein said thin plate is a semiconductor wafer.

5. The method of claim 1, including adjusting the spring force of said compression springs, and adjusting the floating movement amounts of said first and second floating plates.

6. The method of any one of claims 1 and 2, including guiding the movements of said first and second floating plates.

7. A method for polishing an edge of a semiconductor wafer having at least one surface with a rubber wheel containing abrasives and mounted to a spindle drivable to rotate said rubber wheel in a plane normal to the at least one surface of said semiconductor wafer while said semiconductor wafer is mounted to a mount portion movable linearly with respect to said rubber wheel, said spindle and said semiconductor wafer mounting portion being biased by elastic means in a direction to bring said rubber wheel and said edge of said semiconductor wafer in contact with each other, said method comprising the steps of:

(a) driving said spindle to rotate said rubber wheel in the plane normal to said at least one surface of said semiconductor wafer, (b) moving one of said spindle and said semiconductor wafer mounting portion toward and away from the other during a polishing operation, (c) floating said spindle on a first floating plate movable in a plane normal to the plane in which said rubber wheel is rotated, (d) floating said semiconductor wafer mounting portion on a second floating plate movable in a plane parallel with the plane in which said first plate is floated, and (e) bringing said rubber wheel and said edge of said semiconductor wafer into contact with each other under the bias of first and second compression springs of said elastic means acting respectively on said first and second floating plates.

* * * * *